US008091840B1

(12) United States Patent
Ortiz-Torres

(10) Patent No.: US 8,091,840 B1
(45) Date of Patent: Jan. 10, 2012

(54) HOLDER FOR FLEXIBLE WALL CONTAINERS

(76) Inventor: Vicente Ortiz-Torres, Toa Baja, PR (US)

( * ) Notice: Subject to any disclaimer, the term of this patent is extended or adjusted under 35 U.S.C. 154(b) by 0 days.

(21) Appl. No.: 12/383,671

(22) Filed: Mar. 26, 2009

(51) Int. Cl.
*A63B 55/04* (2006.01)

(52) U.S. Cl. ..... 248/97; 248/98; 248/99

(58) Field of Classification Search ..... 248/95, 248/99, 101, 97, 98
See application file for complete search history.

(56) References Cited

U.S. PATENT DOCUMENTS

| | | | | | |
|---|---|---|---|---|---|
| 942,231 | A | * | 12/1909 | Woodman | 248/97 |
| 2,451,829 | A | * | 10/1948 | Hightower | 248/100 |
| 3,768,763 | A | | 10/1973 | Hembree | |
| 3,771,752 | A | | 11/1973 | Meeh | |
| 3,905,406 | A | * | 9/1975 | Cruse | 141/390 |
| 4,124,185 | A | | 11/1978 | Preisinger | |
| 4,174,085 | A | | 11/1979 | Ferreira et al. | |
| 4,202,521 | A | * | 5/1980 | Harding | 248/98 |
| 4,269,441 | A | | 5/1981 | Hirsch | |
| 4,448,434 | A | * | 5/1984 | Anderson | 280/40 |
| 4,705,246 | A | | 11/1987 | Wolf | |
| 4,759,518 | A | | 7/1988 | Yardas | |
| 4,759,519 | A | * | 7/1988 | Cheng | 248/99 |
| 4,783,031 | A | * | 11/1988 | Ebentheuer | 248/97 |
| 4,953,815 | A | | 9/1990 | Beymer et al. | |
| 5,014,943 | A | | 5/1991 | Nelson et al. | |
| 5,016,844 | A | | 5/1991 | Garvin | |
| RE33,842 | E | * | 3/1992 | Ebentheuer | 248/97 |
| 5,106,041 | A | | 4/1992 | Jelincic | |
| 5,180,126 | A | * | 1/1993 | Bennett | 248/99 |
| 5,193,770 | A | | 3/1993 | Kildare | |
| 5,213,291 | A | | 5/1993 | Wiebe | |
| 5,222,536 | A | * | 6/1993 | Hodgdon et al. | 141/390 |
| 5,413,394 | A | * | 5/1995 | Mitchell | 294/1.1 |
| 5,570,862 | A | | 11/1996 | Negent | |
| 5,597,022 | A | | 1/1997 | Reifers | |
| 5,765,789 | A | * | 6/1998 | Ryon et al. | 248/97 |
| 5,842,595 | A | | 12/1998 | Williams | |
| 5,924,657 | A | | 7/1999 | Bach | |
| 6,003,820 | A | | 12/1999 | Baldonado et al. | |
| 6,007,030 | A | | 12/1999 | Judge | |
| 6,068,221 | A | | 5/2000 | Rosen | |
| 6,076,782 | A | * | 6/2000 | Alderman | 248/97 |
| 6,164,607 | A | * | 12/2000 | Hawkes | 248/97 |
| 6,199,802 | B1 | | 3/2001 | Scheibe, Sr. | |
| 6,202,709 | B1 | | 3/2001 | Wymer | |
| 6,267,334 | B1 | | 7/2001 | Siu | |
| D447,845 | S | * | 9/2001 | Neil | D34/6 |
| 6,352,225 | B1 | | 3/2002 | Dooley et al. | |
| 6,511,026 | B2 | * | 1/2003 | Hatfield | 248/97 |
| 6,511,110 | B2 | * | 1/2003 | Roye | 294/1.1 |
| 6,517,033 | B2 | | 2/2003 | Russell et al. | |
| 6,604,717 | B2 | | 8/2003 | Stanfield | |
| 6,676,092 | B2 | | 1/2004 | Tsai | |
| 7,066,847 | B2 | * | 6/2006 | Power | 473/446 |
| 7,404,531 | B2 | | 7/2008 | McConnell | |
| 2005/0103951 | A1 | | 5/2005 | Metcalfe | |
| 2005/0230572 | A1 | | 10/2005 | Fisher | |
| 2006/0096988 | A1 | | 5/2006 | Kim | |
| 2006/0175475 | A1 | * | 8/2006 | Desantis | 248/99 |

* cited by examiner

*Primary Examiner* — Amy Sterling
*Assistant Examiner* — Erin W Smith
(74) *Attorney, Agent, or Firm* — Hector M Reyes Rivera

(57) ABSTRACT

A holder for flexible wall containers or bags for holding collapsible wall container or bag open and thus facilitates the filling of the containers or bags. The holder is formed of easy dissembled parts that may be compacted, thus facilitating its storing or transportation. It is highly versatile since its internal cavity that accommodates the flexible wall container may be assembled in different sizes, allowing the convenience of using it with container or bags of different sizes. The holder is assembled by inserting two arms of a supporting unit into two rotating units of a second supporting unit. The length of the arms inserted in the rotating unit dictates the predetermined housing size of the holder.

18 Claims, 8 Drawing Sheets

HOLDER FOR FLEXIBLE WALL CONTAINERS

TECHNICAL FIELD

The invention relates to a holder for supporting a flexible wall container. More particularly, the invention is directed to a compactable holder for a flexible wall container or bag, which facilitates the filling of such container by maintaining the mouth of said container open and wherein the size of the housing or cavity supporting the flexible wall container is conveniently adjustable to the size of the container.

BACKGROUND OF THE INVENTION

Cleaning areas from leaves, debris and other unwanted materials requires depositing such materials in flexible wall containers or bags; moving through the particular place containing the unwanted materials and transporting the containers or the bags with the unwanted materials to a final disposition place. The cleaning tasks are facilitated by maintaining such containers widely open, protecting the container or bag from puncturing or tearing and facilitating the movement or transportation of the container or bag during and after the cleaning process. Flexible wall containers or bags are commercially available in variable sizes, and thus, the required holder's size should correspond to the container size in order to be properly accommodated said container or bag. Thus, there is a need for a holder for supporting flexible wall containers such as trash bags that is easy to handle, portable, and easy to move through a given area. In addition, there is a need for a flexible wall container's holder that is also compactable, easy to store when not in use and having a housing or cavity adjustable to the size of the flexible wall container.

Therefore, it is an object of the instant invention to provide a holder for flexible wall containers, such as trash bags and the like, that is highly compactable and easy to assemble and disassemble in order to facilitate storing it when not in used or when such holder is transported. Another object of the invention is to provide a holder having an internal housing or cavity that may be releasable secured at predetermined different sizes increasing the utility of the holder when using bags of different sizes. It is another object of the invention to provide a holder for bags or any flexible wall containers capable of being used in vertical or horizontal position with respect to the user's position. Yet another object of the invention is to provide bag holder, which is portable and an easy to transport while in use as well as when compacted and it is not in use.

SUMMARY OF THE INVENTION

The present invention comprises a highly compactable holder for flexible wall containers such as trash bags; which facilitates the filling of the said container by maintaining the open end of the said container open and that is easy to use and manage. The invention comprises an internal housing or cavity that may be reduced or increased in size according with the width and size of the container or bag to be held, said holder further comprising:

a) a left arm and a right arm, substantially parallel to each others, each one of said arms having an upper surface, a lower surface, a proximal end and a distal end;
b) a connecting unit joining the proximal ends of said right and left parallel arms;
c) at least one support leg connected to said connecting unit
d) a rectangular frame having an internal surface, an external surface, a lower section and an upper section;

e) a curved platform mounted at the internal surface of the frame and substantially located at the center of the upper section of said rectangular frame;
f) a right hollow rotator member connected at the right upper section of said rectangular frame;
g) a left hollow rotator member connected at the left upper section of said rectangular frame;
h) means for fastening said parallel arms to said rotator members and wherein an internal housing is created by connecting and securing said right arm with said right hollow rotator member and said left arm with said left hollow rotator member.

BRIEF DESCRIPTION OF THE DRAWINGS

The nature and objects of the present invention and its advantages will be more clearly and easily understood after reading the following non-restricted description of preferred embodiments thereof, made with reference to the following drawings, in which.

DESCRIPTION OF THE PREFERRED EMBODIMENTS

The present invention will now be described more fully hereinafter with reference to the accompanying drawing, in which preferred embodiments of the invention are illustrated. The invention may, however, be embodied in very different forms and should not be construed as limited to the embodiments set forth herein. Rather, these embodiments are provided so that this application will be thorough and complete, and will fully convey the true scope of the invention to those skilled in the art.

Figure 1:
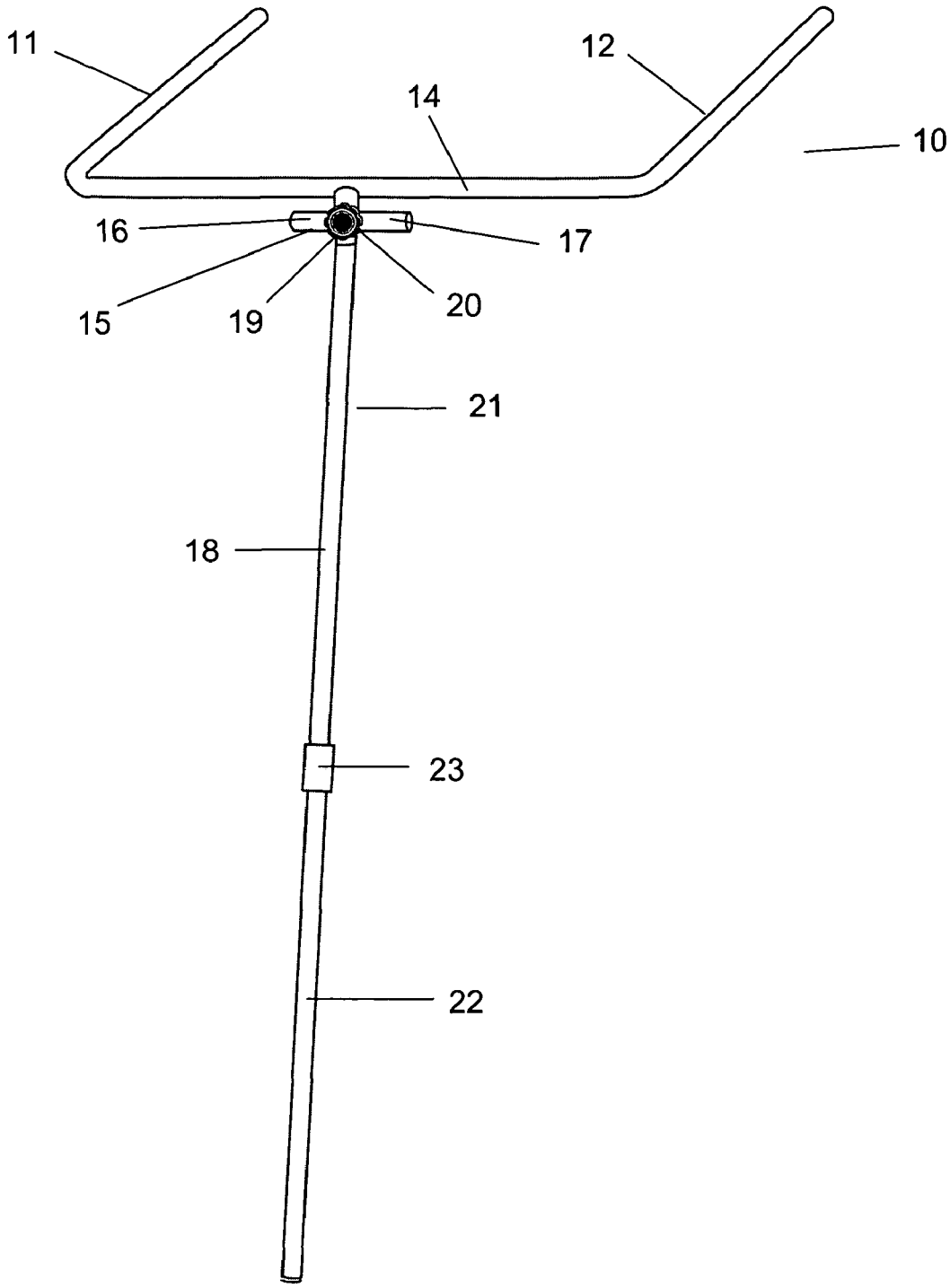
FIG. 1 is a perspective view of first main supporting unit of the instant holder.

The instant invention comprises two main supporting units identified with numerals 10 and 30, that once combined, creates the flexible wall container support or holder 60, having an internal housing or cavity capable of holding the container or bag in an open position and able to protect the surface of said flexible wall container such as a bag or the like in order to facilitates the use of such flexible wall container. As used in this application, a flexible wall container means any container having walls flexible and adaptable to its contains, such as trash bags, laundry bags and the like In reference to the drawings, FIG. 1 shows a perspective view of first supporting unit 10 that may be used in different embodiments of the instant invention. The unit 10 may be made of a solid material, such as plastic or metal but preferable of any suitable metal. Even more preferable, it made be made of aluminum, stainless steel, galvanized steel, iron, galvanized iron or any suitable alloy thereof. Said embodiment comprises a left arm 11 and a right arm 12, such arms being positions substantially parallel to each other. Each one of said arms 11 and 12 has an upper surface, a lower surface, a proximal end and a distal end. Said arms are joined by means of a connecting unit 14, which is connected to the proximal ends of parallel arms. The connection between the parallel arms 11 and 12 and the connecting unit 14 creates a substantially squared U shape like frame. Said frame may be made as a single piece, wherein arms 11 and 12 are bent extensions of connecting unit 14. Located at said U shape frame; preferable at substantially the middle of connecting unit 14, there is an inverted cross unit 15, having a left side 16, a right side 17 and a center side 19. FIG. 3 is a detailed illustration of inverted cross 15, wherein the area within numerals 7" of FIG. 2 has been expanded.

Main supporting unit 10 also comprises at least one supporting leg 18, which is engaged to connecting unit 14 via inverted cross 15. Preferably, the upper section or distal end of supporting leg 18 may be connected to center side 19 by any fastening or tightening means suitable in the art that allows the fastening and an easily detachment of the said supporting leg 18, including any suitable fastening means or tightening mans already known in the art. For example, the distal end of supporting leg 18 as well as the internal lower section of the inverted cross 15, identified with numeral 19 may be cooperatively threaded to allow the proper connection in order to secure supporting leg 18 to connecting unit 14. Alternatively, an internal pressure pin may be inserted in the end section of the supporting leg 18 in such a way that, once said end section of supporting leg 18 is inserted in the interior side of center side 19, said pin may comes out from an aperture on center side 19 in order to firmly fix or abut supporting leg 18 to the center side 19; while once said pin is pressed and the supporting leg 18 is pull out from center side 19, the supporting leg is dissembled from the center side 19. In an even preferred embodiment, the said connection may be achieved by inserting the end of support leg 18 into the lower section of the inverted cross 19 and then securing the said end of the said supporting leg 18 with any suitable means for fastening such as an screw 20 inserted via the center of the inverted cross 15, as is illustrated in FIGS. 1, 2 and 3.

It should be noticed that, preferably, supporting leg 18 may be detachable in at last two sections, 21 and 22 that are hold together by any suitable fastening means or tightening element know in the art, identified generically with numeral 23. The connected leg ends of 21 and 22 may be engage one inside the other by cooperative threading or both ends may be threaded to a double thread holding unit. Alternatively, both such ends may be inserted into a non-threaded external holding unit and further securing such ends with any suitable and known fastening means in the art, such as of screws and the like. Any of the mentioned fastening means are indicated as examples and any possible and known fastening means or tightening means in the art are considered within the scope of the invention.

In a different embodiment of the invention, supporting unit 10 may be an entire or whole unit with all its parts being integrated and physically connected as a single unit, in such case there will be no need for the fastening means indicated above.

Figure 2:
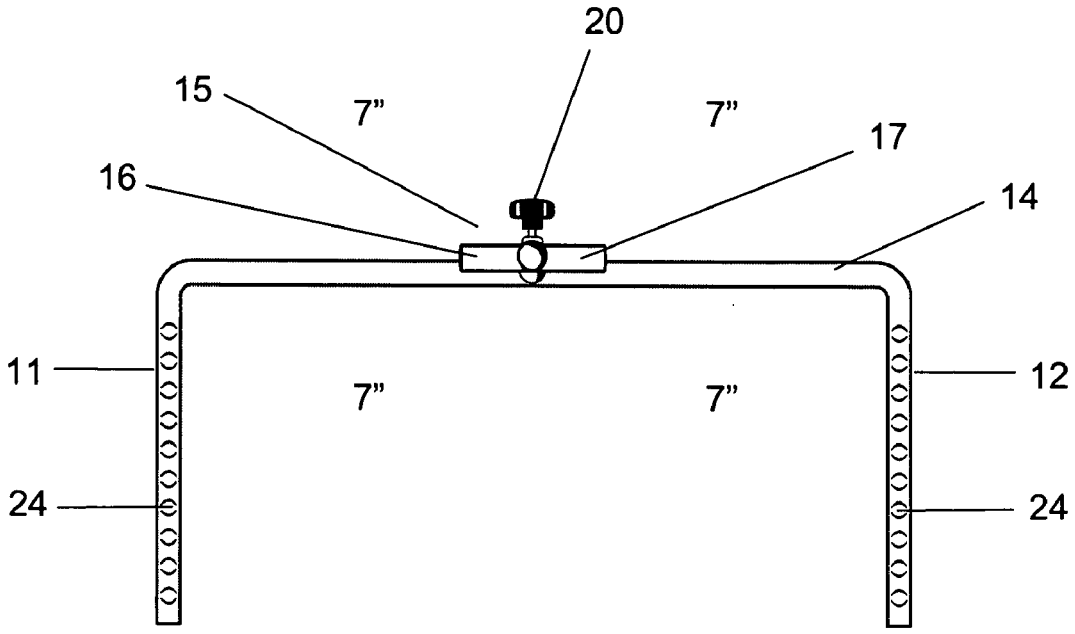
FIG. 2 is a top view of the lower surface of the parallel arms joined by a connecting unit.
Figure 3:
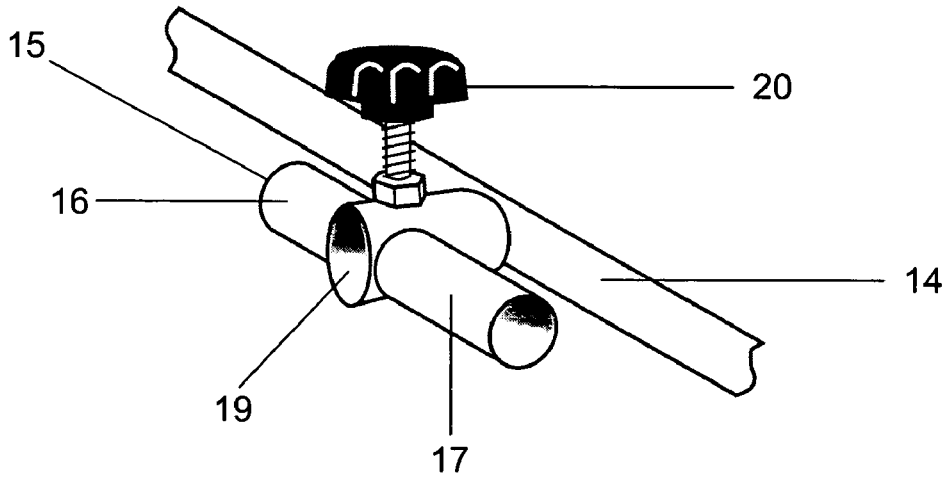
FIG. 3 shows a detailed perspective view of the inverted cross located in the lower surface of the connecting unit.

As indicated in FIG. 2, in a preferred embodiment the left and right arms 11 and 12 contain in the lower surface a series of internal gaps or concavities, identified with numeral 24. By gaps or concavities as used herein, it means any deep concave gap as well as a treaded apertures capable of cooperatively accommodate means for fastening. The number of gaps or concavities 24 is identical in the lower surface of both arms 11 and 12; and they are separated from each other in the same arm at the same determined distance. Each gap or concavity 24 in the right arm 12 is in substantially parallel position to another gap or concavity in the left arm 11. Thus, the total number of gaps or concavities is identical in each one of the arms.

Figure 4:
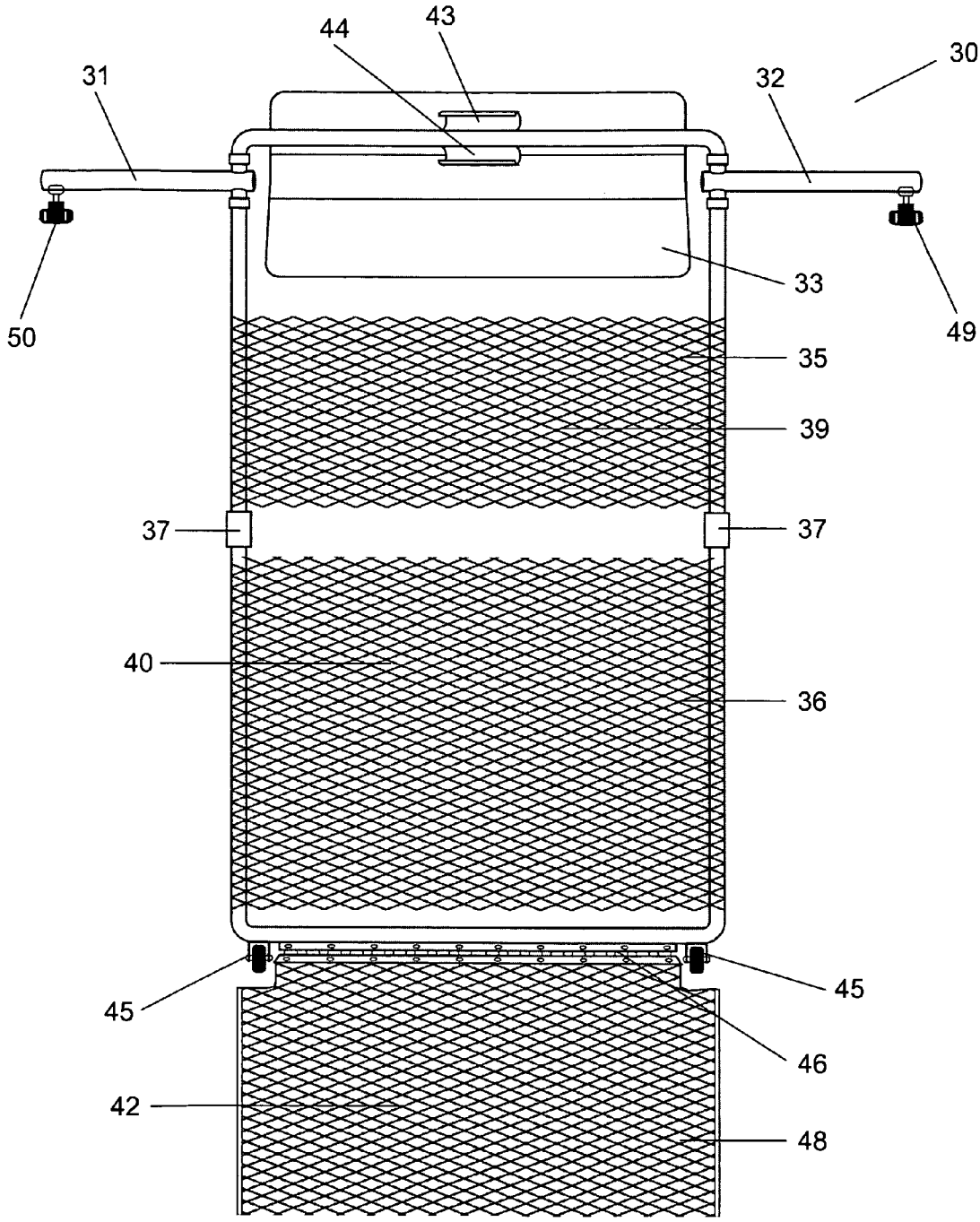
FIG. 4 is a top view of the exterior surface of second main supporting unit that, once combined with the first main supporting unit illustrated in FIG. 1 forms the internal cavity or housing of the invention.
Figure 5:
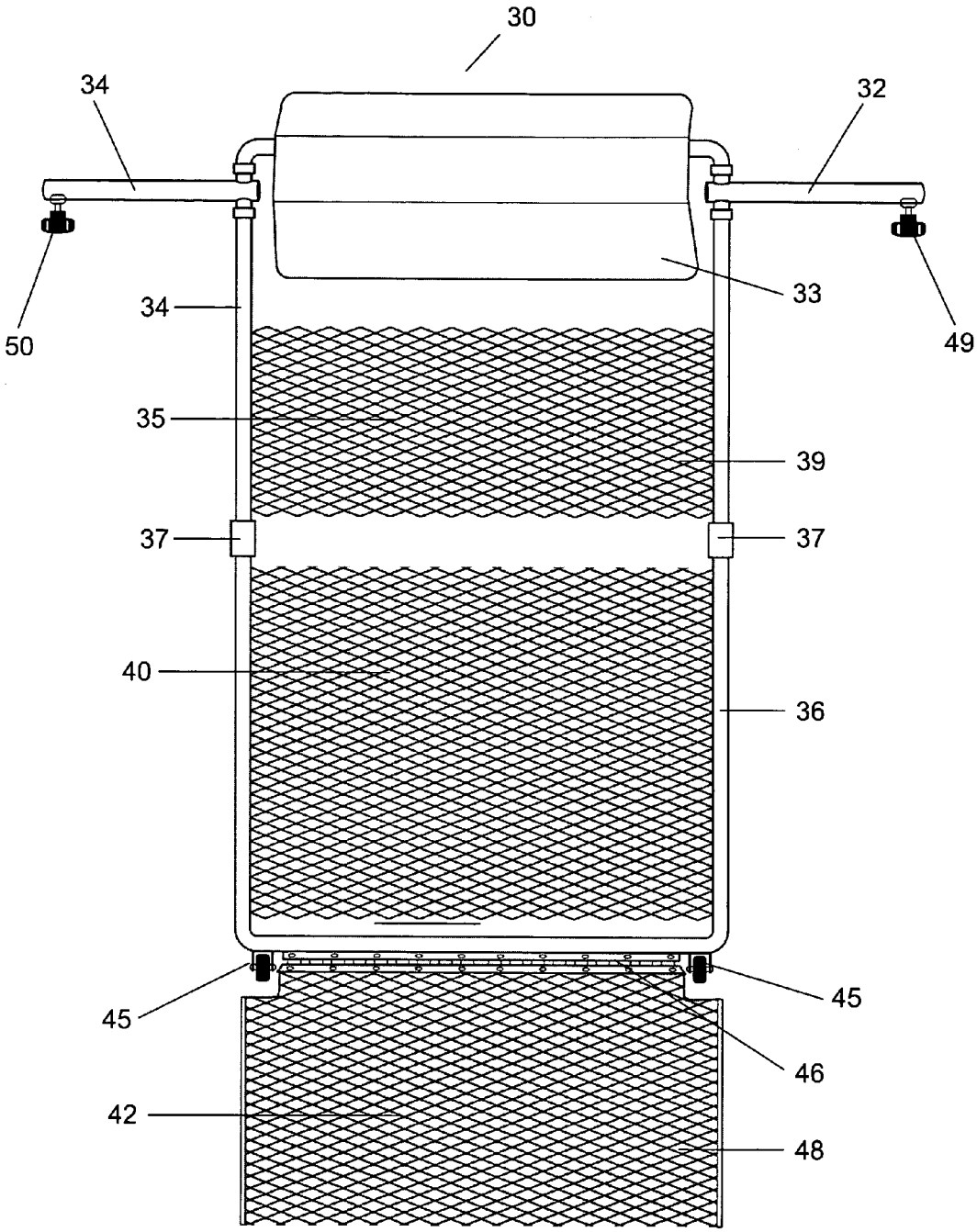
FIG. 5 illustrates a top view of internal surface of the second main supporting unit.

A second main supporting unit 30 is illustrated in FIGS. 4 and 5, wherein the external surface of said supporting unit 30 is illustrated. Said supporting unit 30 comprises a substantially rectangular frame 34 having an internal surface, an external surface, an upper section 35 and a lower section 36. In a preferred embodiment, lower and upper sections 35 and 36 of main frame 34 may be individual sections, connected together in a detachable manner with any suitable fastening means, illustrated generically by connecting unit 37. Said connecting unit 37 may be any of those connecting units already discussed in engaging or connecting leg 18 into sections 21 and 22 or any fastening means discussed above to fast units 21 and 22 in order to form supporting leg 18. Said frame 30 may be made of any solid material such as plastic or metal as discussed previously for supporting unit 10.

Figure 9:
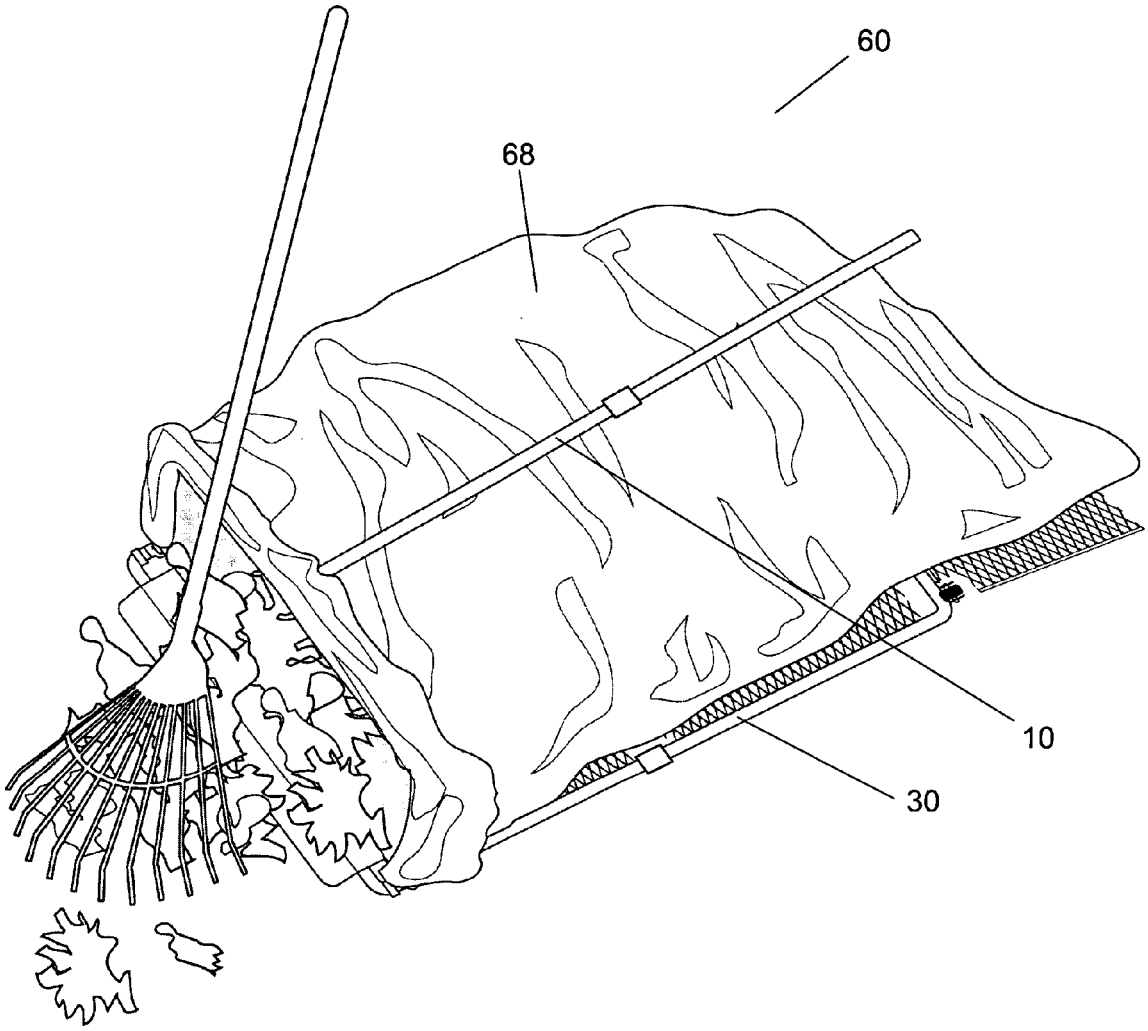
FIG. 9 illustrates the use of the invention horizontal position.

Main supporting unit 30 also comprises at its the upper section, a curved platform 33, which is mounted or located substantially at the center of the upper section of said rectangular frame 34. Platform 33 facilitates sweeping trash or any waste into the bag inside the cavity of the holder 60, when it is use in horizontal position as illustrated in FIG. 9.

At the right upper section of supporting unit 30, a right hollow rotator member 32 is connected at the right upper section of said rectangular frame 34. Similarly, a left hollow rotator member 31 is connected at the left upper section of said rectangular frame 34. In a preferred embodiment, the said hollow rotator members 31 and 32 are located parallel to each other. A preferred manner to connect each of the said rotator members 31 and 32 to the rectangular frame 34 is by passing the frame 34 through an aperture at one of the ends of each one of the rotator members 31 and 32, thus allowing the circular movement of such members along the axis of the frame 34 and thus allowing positioning of the said rotator members 31 and 32 in multiple positions in respect to the main frame 34.

Once the said rotator members 31 and 32 are positioned substantially perpendicular to main frame 34 and after connecting and securing or tightening right arm 12 with said right hollow rotator member 32 and left arm 11 with left hollow rotator member 31 respectively, an internal housing or cavity is formed. The size of said internal housing or cavity is variable; since its size depends on how far the arms 11 and 12 are inserted and tightened in the interior rotator members 31 and 32, respectively. Thus, by adjusting the length of arms 11 and 12 inserted into rotator members 31 and 32, a predetermined, desirable or convenient size's housing or cavity is formed. Once arms 11 and 12 are inserted to a predetermined distance within the rotator members 31 and 32, clockwise turning of screws 49 and 50 provides a housing or cavity to accommodate a container having the corresponding size.

The invention also comprises any suitable fastening means intended to secure the arm-rotator member connection in a manner easy to disconnect. For instance, screws 49 and 50, located at the proximal end of rotator members 31 and 32 may be conveniently used to secure the arm-rotator connection. The said screws are in a cooperative relationship with gaps or cavities 24, located at the lower surface of arms 11 and 12, meaning that by turning the said screws clockwise until impacting the corresponding gap 24, creates an internal housing by joining main supporting units 10 and 30. On the other hand, unscrewing the said screws and pulling the arms outside the rotator units 31 and 32 allows an easy dissemble of said main supporting units 10 and 30. The instant invention also comprises any other possible fastening means capable of holding together arms 11 and 12 with rotator members 31 and 32, respectively.

In a preferred embodiment, main supporting unit 30 may include at least one wheel 45 located at substantially the center of the lower end of the supporting unit 30, while in another embodiment, the invention may have two wheels 45, located at substantially the extremes point of the lower section of main rectangular frame 34, as illustrated in FIGS. 4 and 5.

Similarly, the invention may include a flat rotatable panel 42 connected to the lower side of said rectangular frame by mean of a hinge 46 or any other suitable means. Said rotatable panel is intended to form the bottom like protection in the housing created once the main supporting units 10 and 30 are assembled and it is intended to protect the bottom of the flexible wall container or bag inserted in the holder 60. Main supporting unit 30 may comprise lattice sections 39 and 40 connected to the peripheral sides of said rectangular frame 34 to add strength to said frame and lattice section 42, which add strength to rotatable panel 42 and further protects the wall flexible container from tearing or puncturing.

As illustrated in FIG. 4, supporting unit 30 also includes two concave units 43 and 44, located under curved platform 33, in order to provide storing place of units 21 and 22 that forms the supporting leg 18. FIG. 5 illustrates the reverse internal side of supporting unit 30.

Figure 6:
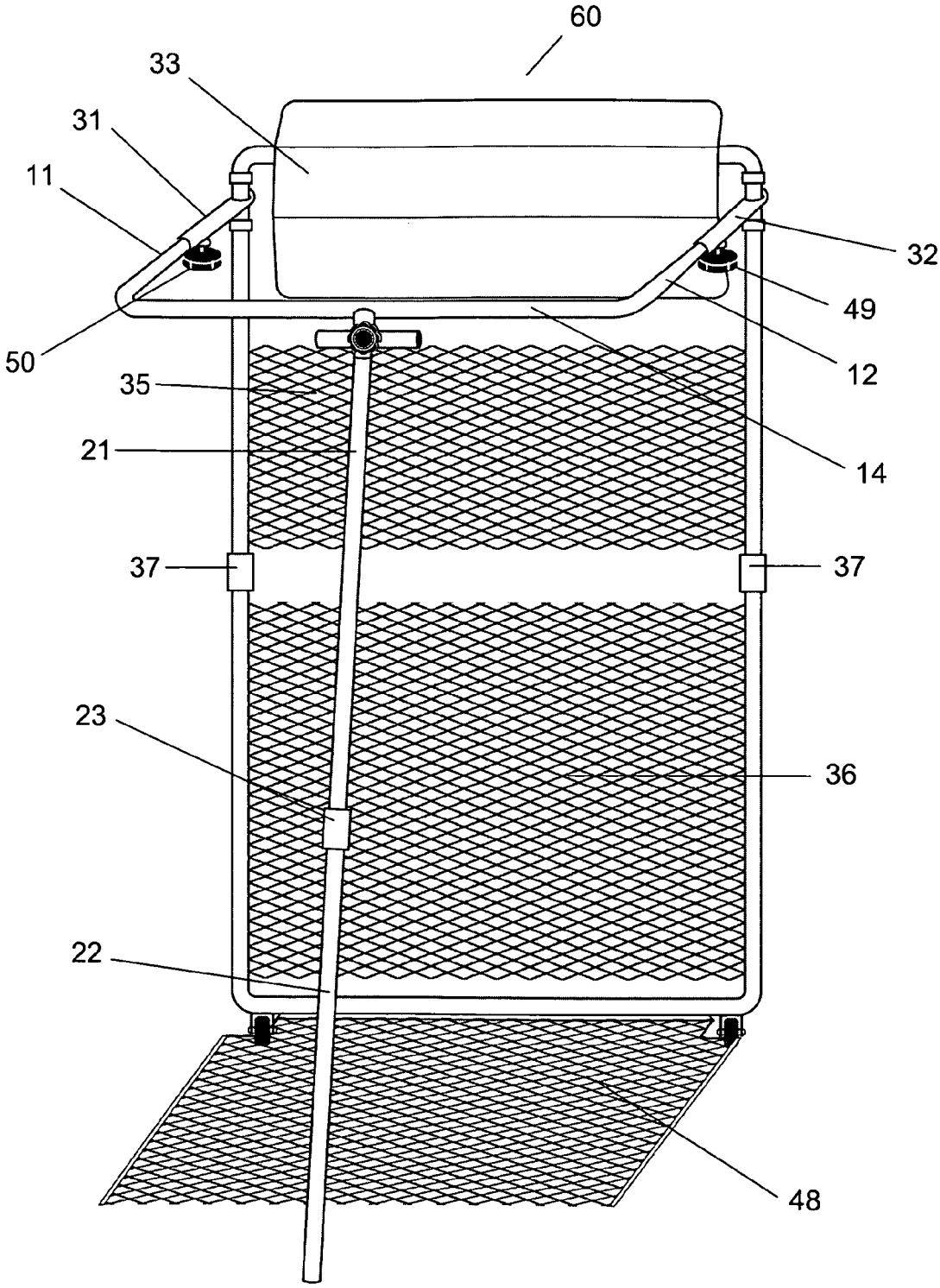
FIG. 6 illustrates a preferred embodiment of the device already assembled, wherein the first main supporting unit is connected to the second main supporting unit, thus creating an internal housing or cavity wherein the flexible wall container is inserted.
Figure 8:
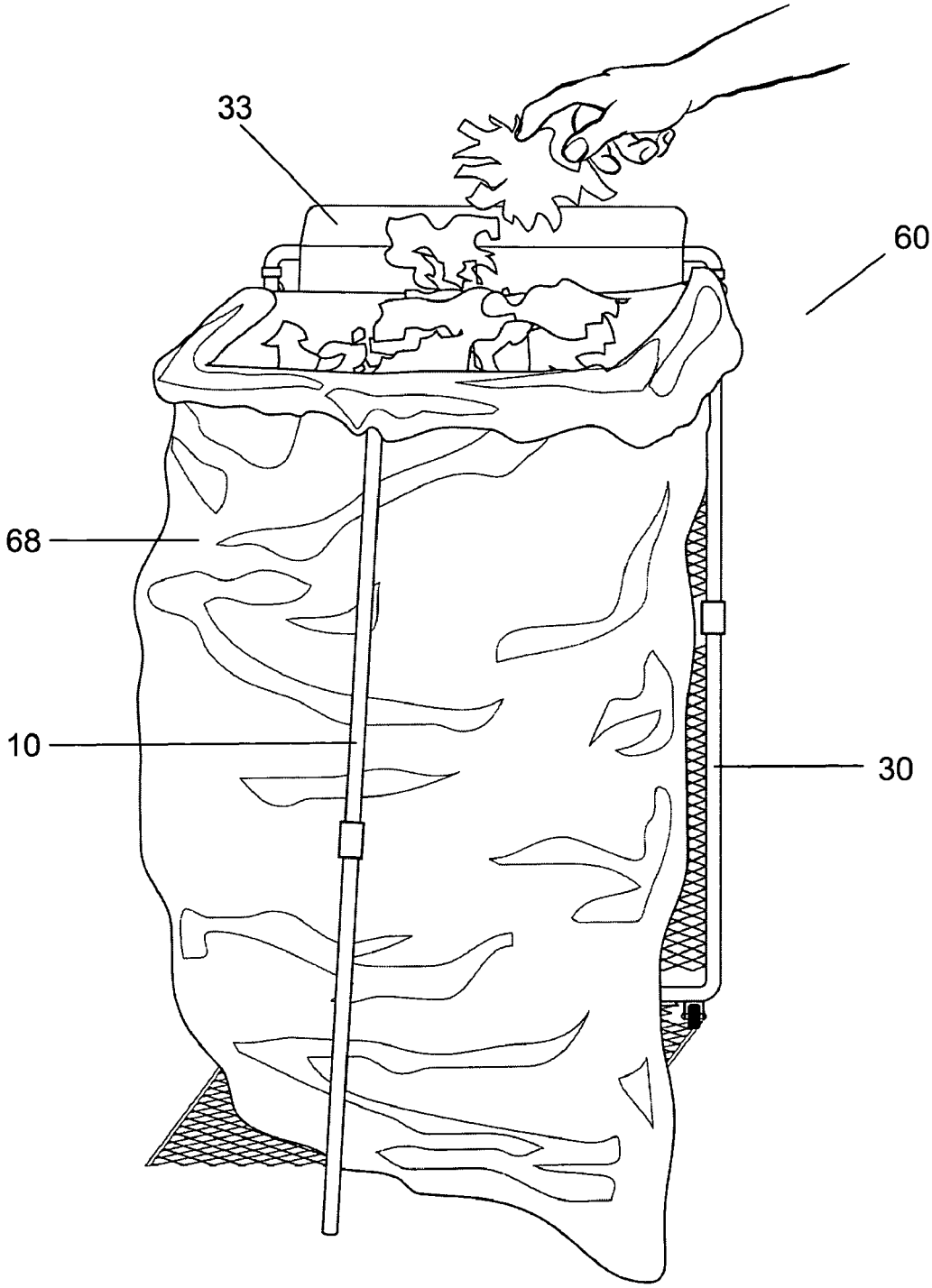
FIG. 8 illustrates the use of the invention in a vertical position.

As illustrated in FIG. 6, once the main units 10 and 30 are connected and secured as explained above, the holder 60 is assembled and ready to use by inserting a flexible wall container or bag in the interior of the housing or cavity of 60, while folding the mouth of said flexible wall container or bag over the top of the holder 60. The assembled holder 60 may be use vertically to the floor or alternatively, it may be used while positioned horizontally to the floor as illustrated in FIGS. 8 and 9, respectively.

Figure 7:
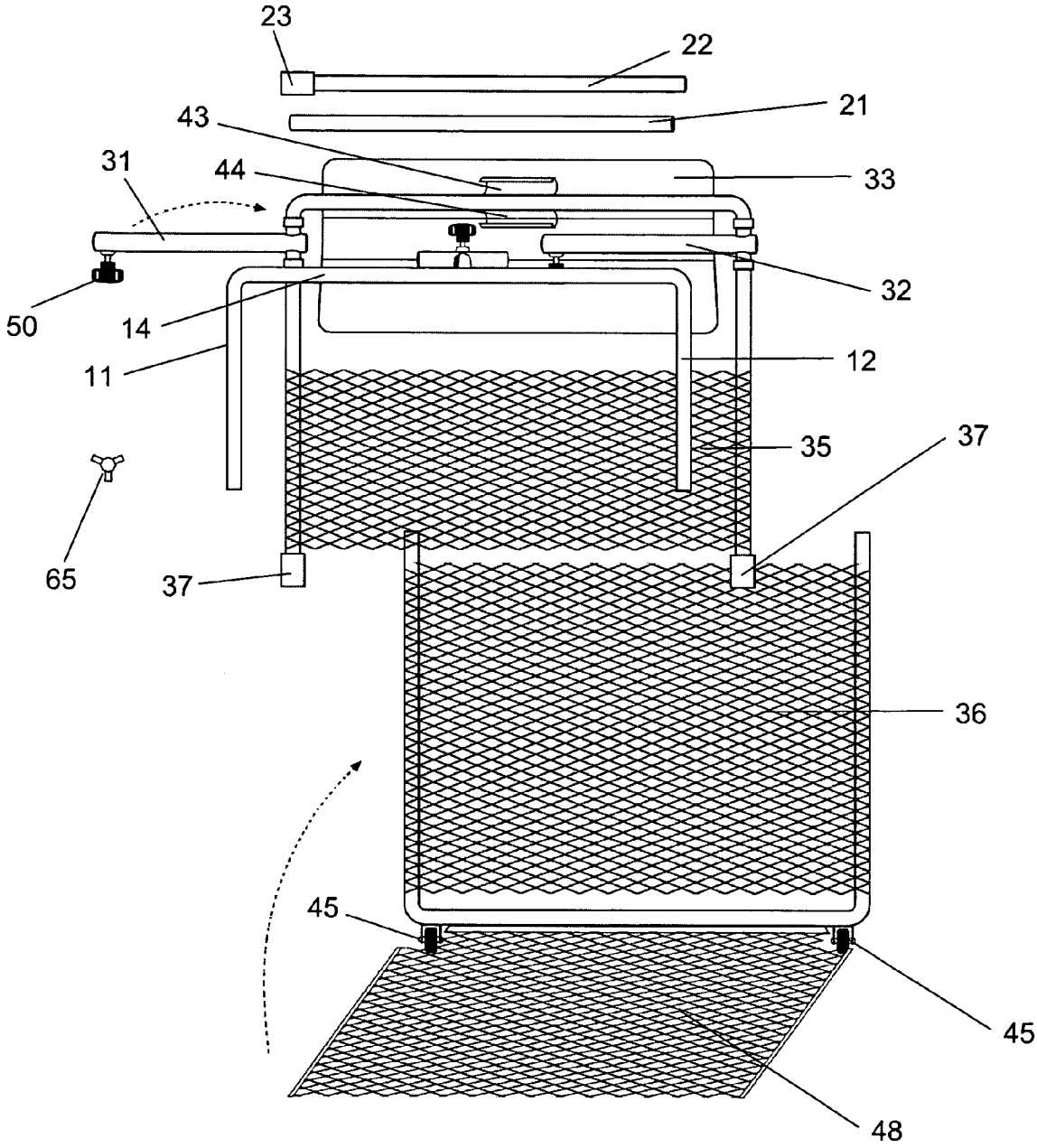
FIG. 7 illustrates the compact and collapsible manner to disassemble, organize and store the invention.

The preferred embodiment of the invention is collapsible since it may be dissembled and conveniently store in a very compactable manner, as illustrated in FIG. 7. Disconnecting the arm-rotator member connection, results in two supporting units 10, and 30. A compacted, organized storing of the holder is achieved by (1) unfastening the means for fastening supporting leg 18 and thus providing two units 21 and 22, and further snapping units 21 and 22 in concave spaces 43 and 44; (2) unfastening means for fastening 37, thus provides the lower section 36 and the upper section 35 of the rectangular frame as two individual units; (3) inserting the upper section 35 of the rectangular frame between the flat rotatable surface 42 and the lower unit 36 of rectangular frame; (4) moving rotator members 31 and 32 until they are in contact with the surface of curved platform 33 while the proximal ends of each one of the inverted cross 16 and 17 are inserted in proximal ends of the rotator member 31 and 32 and (5) further securing the collapsed parts using a fastening means, such as screw 53 in order to hold on all the section together.

What is claimed is:

1. A holder device for supporting a flexible wall container or bag in an open position, said holder comprising:

a first main supporting unit, said first supporting unit comprising:

a left arm and a right arm, substantially parallel to each other, each one of the said arms having an upper surface, a lower surface, a proximal end and a distal end;

a straight connecting unit, joining the proximal ends of said right and left parallel arms; wherein the connection of the left and right arms with the connecting unit creates a substantially; rectangular U shaped frame, thus having two angles substantially of 90 degrees;

at least one supporting leg connected to said connecting unit;

a second main supporting unit, said second supporting unit comprising:

a rectangular frame having an internal surface, an external surface, a lower section and an upper section;

a curved platform mounted at the internal surface of the frame and substantially located at the center of the upper section of said rectangular frame;

a right hollow rotator member; said right hollow rotator member comprising an elongated cylindrical straight body, a fastening means for fastening said right arm and said right hollow rotator member; wherein said fastening means are located at near the proximal end of said elongated cylindrical straight body, a hole passing through the top and bottom surfaces near the distal end of said elongated cylindrical straight body from wherein the rectangular frame pass through vertically allowing said rotator members to freely rotate around the axis of the main rectangular frame;

a left hollow rotator member, said left hollow rotator member comprising:

an elongated cylindrical straight body; a fastening means for fastening said left arm and said left hollow rotator member; wherein said fastening means are located at near the proximal end of said elongated cylindrical straight body, a hole passing through the top and bottom surfaces near the distal end of said elongated cylindrical straight body from wherein the rectangular frame pass through vertically allowing said rotator members to freely rotate around the axis of the main rectangular frame and;

wherein the holder having a rectangular top opening and an particular size internal housing or cavity is created by connecting and securing in a nonpermanent manner, the first main supporting unit to the second main supporting unit through the insertion of said right arm with said right hollow rotator member and said left arm with said left hollow rotator member and wherein a particular size of the created cavity is controlled, increased or decreased at the user's convenience by selecting the length of the left and right arms to be inserted and secured in a nonpermanent manner into the left and right rotator units, respectively.

2. The holder as recited in claim 1, further comprising multiple aligned gaps on the lower surface of said right and left arms.

3. The holder as recited in claim 2, wherein the means for fastening the parallel arms with said rotator members comprises a screw at the external surface of the rotator member in cooperation with any of said gaps on the lower surface of the said arms.

4. The holder as recited in claim 1, further comprising a hollow inverted cross shaped unit, located at substantially in between the center of the connecting unit, and the supporting leg.

5. The holder of claim 4, further comprising means for fastening said removable leg to substantially the center of the inverted cross unit.

6. The holder as recited in claim 5, wherein said support leg is formed by two different units joined in a detachable manner and means for fastening each one of said two different units.

7. The holder as recited in claim 6, further comprising at least a wheel at the lower section of said rectangular frame.

8. The holder as recited in claim 7, having at least two wheels one on each extremes of the lower section of said rectangular frame.

9. The holder of claim 1, wherein said upper section and said lower section of the rectangular frame are detachable as independent units.

10. The holder of claim 9, further comprising means for fastening the upper and lower sections of said rectangular frame.

11. The holder of claim 10, wherein the means for fastening the upper and lower sections of said rectangular frame are located at substantially the left and right middle of said rectangular frame.

12. The holder of claim 1, further comprising lattice sections connected to the peripheral sides of said rectangular frame.

13. The holder of claim 1, further comprising a flat rotatable panel connected to the lower side of said rectangular frame.

14. The holder of claim 12, wherein said flat rotatable panel is connected to said rectangular frame with a hinge.

15. The holder of claim 13, wherein said flat rotatable panel further comprises a lattice connected to the peripheral sides of said rotatable panel.

16. The holder of claim 12, further comprising means for holding the dissembled parts of the holder tightly compacted.

17. The holder of claim 12, wherein said means for holding the dissembled parts of the holder tightly compacted is a screw and a cooperative nut.

18. A holder device for supporting a flexible wall container or bag in an open position, said holder comprising:

a first connecting unit, said first connecting unit comprising:

a left arm and a right arm, substantially parallel to each other, each one of the said arms having an upper surface, a lower surface, a proximal end and a distal end;

a straight connecting unit, joining the proximal ends of said right and left parallel arms; wherein the connection of the left and right arms with the connecting unit creates a substantially rectangular U shaped frame, thus having two angles of 90 degrees;

at least one supporting leg connected to said connecting unit;

a second connecting unit, said second connecting unit comprising:

a rectangular frame having an internal surface, an external surface, a lower section and an upper section;

a lattice sections connected to the peripheral sides of said rectangular frame;

a curved platform mounted at the internal surface of the frame and substantially located at the center of the upper section of said rectangular frame;

a right hollow rotator member; said right hollow rotator member comprising:

an elongated cylindrical straight body, a fastening means for fastening said right arm and said right hollow rotator member; wherein said fastening means are located at near the proximal end of said elongated cylindrical straight body, a hole passing through the top and bottom surfaces near the distal end of said elongated cylindrical straight body from wherein the rectangular frame pass through vertically and allowing said rotator members to freely rotate around the axis of the main rectangular frame;

a left hollow rotator member, said left hollow rotator member comprising:

an elongated cylindrical straight body; a fastening means for fastening said left arm and said left hollow rotator member; wherein said fastening means are located at near the proximal end of said elongated cylindrical straight body, hole a hole passing through the top and bottom surfaces near the distal end of said elongated cylindrical straight body from wherein the rectangular frame pass through vertically and allowing said rotator members to freely rotate around the axis of the main rectangular frame;

and;

wherein the holder having a rectangular top opening and an particular size internal housing or cavity is created by connecting and securing in a nonpermanent manner, the first main supporting unit to the second main supporting unit through the insertion of said right arm with said right hollow rotator member and said left arm with said left hollow rotator member and wherein a particular size of the created cavity is controlled, increased or decreased at the user's convenience by selecting the length of the left and right arms to be inserted and secured in a nonpermanent manner into the left and right rotator units, respectively.

* * * * *